US005407892A

United States Patent [19]

Murakami et al.

[11] Patent Number: 5,407,892

[45] Date of Patent: Apr. 18, 1995

[54] CARBONLESS COPYING PAPER

[75] Inventors: Yoshihide Murakami; Shingo Tachizawa; Takeo Sugiyama, all of Tokyo, Japan

[73] Assignee: Mitsubishi Paper Mills Limited, Tokyo, Japan

[21] Appl. No.: 134,696

[22] Filed: Oct. 12, 1993

Related U.S. Application Data

[62] Division of Ser. No. 732,239, Jul. 18, 1991, Pat. No. 5,288,667.

[30] Foreign Application Priority Data

Jul. 20, 1990 [JP] Japan ..... 2-192437
Jul. 27, 1990 [JP] Japan ..... 2-200844
Oct. 1, 1990 [JP] Japan ..... 2-263386

[51] Int. Cl.[6] ..... B41M 5/155

[52] U.S. Cl. ..... 503/209; 503/200; 503/207; 503/209; 503/214; 503/215

[58] Field of Search ..... 503/209, 214, 215, 200, 503/207; 427/150–152

[56] References Cited

U.S. PATENT DOCUMENTS 4,688,060 8/1987 Tanaka et al. ..... 503/214
4,931,422 6/1990 Ishiguro et al. ..... 503/214

FOREIGN PATENT DOCUMENTS 3828084 3/1989 Germany ..... 503/214
58-155992 12/1983 Japan ..... 503/214

OTHER PUBLICATIONS

Derwent English Abstract JP 63-063021 Mar. 1988.
Derwent English Abstract JP 63-063022 Mar. 1988.

*Primary Examiner*—B. Hamilton Hess
*Attorney, Agent, or Firm*—Cushman, Darby & Cushman

[57] ABSTRACT

The present invention is characterized by using an ampholytic latex as binder in a carbonless copying paper prepared by coating on a support a coating composition comprising a stilt agent, a binder and anionic microcapsules containing a color former and drying the composition. The present invention is further characterized by using an association forming polymer in a coating composition in a carbonless copying paper prepared by coating on a support a coating composition containing a stilt agent, a binder mainly composed of a latex and microcapsules containing a color former and drying the coating composition. The present invention is further characterized by using an association forming polymer in a coating composition without using a stilt agent in a carbonless pressure-sensitive copying paper prepared by coating a coating composition comprising a latex and microcapsules containing a color former and drying the composition.

16 Claims, No Drawings

CARBONLESS COPYING PAPER

This is a division of application No. 07/732,239, filed Jul. 18, 1991, now abandoned.

BACKGROUND OF THE INVENTION

The present invention relates to a carbonless copying paper having a coated layer containing microcapsules. More particularly, it relates to a carbonless copying paper excellent in resistance to smudging and in applicability of coating color. Furthermore, it relates to a carbonless copying paper which is excellent in feel and printability.

A carbonless copying paper is produced by coating a color developer and microcapsules containing a normally colorless leuco dye (color former) on a support. The color developer and the microcapsules are coated on a support separately which is used as a upper sheet and a lower sheet respectively; or, they are coated on front and back sides of a support respectively, which is used as a middle sheet. Furthermore, a self-contained copying paper, in which the color developer and the microcapsules are coated on the same side of a support in one or two layers, is also used. A plurality of these sheets which are suitably combined are applied with physical pressure by writing, typing, impact printer, and the like to rupture the microcapsules and release the leuco dye enclosed in the capsules, which contacts with the color developer to cause formation of color to obtain a recorded image.

In general, carbonless copying papers are required to fulfil the following requirements as important quality criteria.

1. Clear images of high density can be obtained in a short time and do not fade with the lapse of time.
2. Smudging, which is undesirable color formation, does not occur. That is, a carbonless copying paper must be resistant to such color formation during its production steps, cutting, printing, or storaging and handling in the form of sheets or rolls.

Since the above requirements 1 and 2 are contrary to each other, it is generally difficult to satisfy both of them and balance them. In general, a coating composition containing microcapsules comprises the microcapsules, a stilt agent, a binder and other additives, and by adjusting each of those components as exemplified in the following (a), (b) and (c), aforesaid conflicting requirements can be brought into a better balance, and a lot of proposals have been made in this regards:

(a) conditions for production of microcapsules;

(b) selection of kind and amount of stilt agent; and (c) selection of kind and amount of binder.

With reference to the method for production of microcapsules enclosing color former of (a), many methods have been known and representative ones are the following.

A coacervation method utilizing a poly-ion complex of gelatin and gum arabic.

An interfacial polymerization method, according to which a hydrophobic solution to be encapsulated is dispersed in a hydrophilic medium to allow formation of a water-insoluble film at the interface of said dispersed hydrophobic solution.

An in-situ polymerization method according to which a film forming resin precondensate such as melamine-formaline resin, urea-formalin resin, or the like is added to an aqueous dispersion in which a hydrophobic solution to be encapsulated has been dispersed and emulsified to allow polymerization of the resin precondensate on the surface of the emulsified solution particles.

Recently, synthetic resin microcapsules, especially those which are produced by the in-situ method, come to be used increasingly because the starting materials can be supplied inexpensively and stably, a microcapsule emulsion of high concentration can be obtained and the production process is simple.

As a means to attain a better balance of said requirements 1 and 2, aggregation of anionic microcapsules by use of an amphoteric polyelectrolyte such as gelatin, and hardening the aggregated capsule wall by use of formaldehyde or the like has been proposed. (Japanese Patent Kokai No. Sho 60-166026).

With reference to the stilt agent of the above (b), there have been used, in an amount of 10–400 parts by weight per 100 parts by solid weight of microcapsules of glass beads disclosed in U.S. Pat. No. 2,711,375, pulverized cellulosic fibers (cellulose flocks) disclosed in U.S. Pat. No. 2,711,375, and ungelatinized starch particles (wheat starch, potato starch, pea flower starch, and the like) disclosed in Japanese Patent Kokoku Nos. Sho 47-1178 and 48-33204. In general, these stilt agents are inert particles (generally having a diameter of 5–50 $\mu$m) somewhat larger than the microcapsule particle.

The stilt agent is very important for protection of microcapsules, but when a coating composition containing it is applied by a contact coating system such as a blade coater (flexible blade coater, trailing blade coater, fountain blade coater and the like) and a rod bar coater, the agent tends to be scraped off, and sometimes fails to be retained sufficiently. Besides, use of it results in a conspicuously ragged coated surface affecting harmfully on feel and printability (especially transferability of ink) of the microcapsules coated paper. Recently, customers have come to demand not only functional performance of carbonless copying paper but also its beautifulness including feel and texture of the paper. Moreover, market of the paper is ever becoming diversified and needs to print on microcapsule coated surface of the paper are increasing. To comply with these needs, coating compositions containing no stilt agent have been proposed. (Japanese Patent Kokai Nos. 61-151271, 61-192586, 61-241185, and 61-241186).

With reference to the above (c), selection of kind and amount of binders, use of various latexes has been proposed. Use of them is also disclosed in the above-mentioned coating compositions containing no stilt agent. As compared to other binders known in the art (polyvinyl alcohol, starch, and the like), a latex is thought to have the merit by itself of higher cushioning action. On the other hand, a latex tends to penetrate into the support as it comprises fine emulsified particles, so that merit fails to be brought up sufficiently in many cases.

To suppress penetration of a latex, it has been proposed to employ totally or partially an alkali-soluble emulsion type latex which thickens the coating composition (Japanese Patent Kokai Nos. Sho 64-49678 and Hei 1-234289, 1-234290, 1-288480, and 2-3367).

However, the above various proposals have not yet resulted in satisfactory products.

SUMMARY OF THE INVENTION

According to the present invention, the problems in quality and in production of the conventional carbonless copying papers are simultaneously overcome. That is, the object of the present invention is to remarkably reduce smudging due to color formation while color development intensity is maintained sufficient.

In detail, an object is to improve balance of the following characteristics A and B which are conflicting with each other.

A. To improve color development intensity:

That is, a clear copied image of high density can be obtained even when a large number of copies are made.

B. To prevent smudging due to color formation when color formation is not desired:

Kinds of smudges due to color formation are as follows. (The carbonless copying paper is required to resist to all of these smudges.)

Dynamic smudging due to color formation caused by rubbing.

Smudge due to color formation under a static pressure applied to the paper in the form of sheets or rolls during storage, transportation, printing or other processing steps such as Guillotine sheeting.

Smudge due to color formation caused by rupture of microcapsules when the paper is stored for a long time under high temperature and humid conditions.

Another object of the present invention is to additionally improve the following characteristics C.

C. Miscellaneous characteristics:

Feel (namely, the smooth coated surface good in hand feeling.)

Printability (good ink transfer on a press.)

Coating processibility on a contact coating system (namely, there occurs no rupture of microcapsules during coating.)

According to the present invention, carbonless copying paper satisfying the above requirements can be obtained.

The problems have been solved by the inventors by using an amphoteric latex as binder in a carbonless copying paper prepared by coating on a support a coating composition containing a stilt agent, a binder, and anionic microcapsules containing a color former therein and drying the coated layer.

The problems have been further solved by using an association forming polymer in a coating composition in a carbonless copying paper prepared by coating on a support a coating composition containing a stilt agent, a binder mainly composed of a latex, and microcapsules enclosing a color former therein and drying the coated layer.

The problems have been further solved by using an association forming polymer in a coating composition without using a stilt agent in a carbonless copying paper prepared by coating a coating composition containing a latex and microcapsules enclosing a color former therein and drying the coat.

DESCRIPTION OF THE INVENTION

The amphoteric latexes used in the present invention are those which have the property of ionically associating with anionic microcapsules at a pH within the range of 7–14 upon being mixed with anionic microcapsules, thereby to partially aggregate and/or agglomerate the microcapsules. These are preferably latexes comprising a substance having a cationic group and an anionic group in the same molecule and/or a mixture of a substance having a cationic group and a substance having an anionic group.

Recently, amphoteric latexes have been developed and the effect of the present invention can be obtained by using them.

The amphoteric latexes used in the present invention are those of a broad scope including emulsified polymer compounds obtained by solution polymerization and those obtained by emulsion polymerization.

When microcapsules are prepared using an anionic polymer as an emulsifier, the resulting microcapsules per se are generally anionic. On the other hand, the conventionally used latexes are also generally anionic. When the microcapsules and the latex are mixed, they never bond to or aggregate with each other owing to static repulsion. If a cationic substance is added, they aggregate, but because it is generally a strong bonding, they become a large agglomeration, resulting in a coating composition which is improper for carbonless copying papers.

When an ampholytic latex is added, particules of the ampholytic latex discontinuously adhere to the surface of capsules to protect the microcapsules. An upper sheet (CB) prepared by coating such composition shows a marked improvement in smudge resistance since the microcapsules are sufficiently protected by the latex particles. When a color is to develop, namely the microcapsules are subjected to a pressure of 200–600 $kg/cm^2$, they become ruptured and release internal phase easily since they are protected only discontinuously by emulsified particles. Use of amphoteric latex helps improve rheological property of the coating composition as well.

On the other hand, if a water-soluble amphoteric polymer such as gelatin is used, its molecules cover surface of the microcapsules continuously so that resistance to smudge due to color formation is improved, but release of internal phase of the microcapsules upon rapture is insufficient so that a desirable color development performance cannot be obtained. Besides, use of such amphoteric polymer fails to give such improvement in coating rheology of the coating composition as that attainable by use of the amphoteric latexes.

The amphoteric latexes used in the present invention are especially preferably those which are prepared by the following processes, but the latexes are never limited thereto as far as they have the property of ionically associating with anionic capsules at a pH of 7–14 upon being mixed with anionic microcapsules to partially aggregate and/or agglomerate the microcapsules.

(1) Emulsion polymerization for obtaining an anionic latex is carried out using partially a cationic monomer.

(2) After preparation of an anionic latex, a part of anionic groups and/or nonionic groups are chemically converted to cationic groups.

(3) A cationic and/or amphoteric dispersant is used as a dispersant for anionic latex.

As an example of the process (1), use of a (meth)acrylic ester type monomer such as N,N-dimethylaminoethyl methacrylate (DM) has been proposed (Japanese Patent Kokai No. Sho 61-261302).

In an example of the process (2), conversion to amphoteric latex is carried out by converting an acrylamide group of an acrylamide group-containing latex to an amino group by Hofmann rearrangement. Introduction of a tertiary amine by Mannich reaction is also possible.

The cationic dispersants used in the process (3) include, for example, laurylpyridinium chloride, octylbenzyltrimethylammonium chloride, dodecyltrimethylammonium chloride, and a condensate of a primary aliphatic amine and ethylene oxide. The amphoteric dispersants include, for example, cocoa-β-alanine, a methyl ester of dimethyloctadecylbetain chloride and quaternary amine derivatives of fatty acids such as cetyldimethylammonium internal carboxylates.

Amount of the amphoteric latex used may vary depending on balance of ionic strength but is preferably 0.1–100 parts by solid weight per 100 parts by solid weight of the anionic microcapsules.

As the binder, it is possible to use, in combination with the amphoteric latex, anionic latexes such as styrene-butadiene copolymer latex, vinyl acetate type latex, and acrylic type latex; or alkali-thickening type anionic latexes. As the alkali-thickening type anionic latexes, there may be used the above-mentioned ones which are generally used. Moreover, water-soluble polymers such as starch, casein, gelatin, gum arabic, polyvinyl alcohol and methyl cellulose may be used in a suitable amount in combination with the amphoteric latex. Amount of the binder used in combination with the amphoteric latex is preferably 0–100 parts by solid weight, especially preferably 0–50 parts by solid weight based on 100 parts by solid weight of the microcapsules.

The stilt agents are added for inhibition of rupture of the microcapsules. In general, preferred are wheat starch, potato starch, corn starch, cellulose powder, synthetic plastic pigment and so on. Amount of the stilt agent used is preferably 10–400 parts by solid weight, especially preferably 10–100 parts by solid weight based on 100 parts by solid weight of the microcapsules.

The association forming polymers used in the present invention are water-soluble polymers or polymer emulsions which associate with the latexes and the microcapsules within the pH range of 7–14 to partially aggregate or agglomerate the latex and the microcapsules. From a viewpoint of surface chemistry, they are polymers or polymer emulsions which associate with the latex and the microcapsules by interaction of hydrophobic groups.

Preferred association forming polymers are:

(1) water-soluble polymer or polymer emulsions in which hydrophobic groups are localized at two or more positions of the polymer and (2) water-soluble polymers or polymer emulsions in which hydrophobic groups are localized at at least both ends of the polymer.

Monomers used for polymerization include, for example, olefin derivatives (such as ethylene, 1-butene, 2-butene, isobutene, and 3-methyl-l-butene), diene derivatives (such as propadiene, 1,2-butadiene, 1,3-butadiene, 2,3-dimethyl-1,3-butadiene, 1,2-pentadiene, -methyl-1,3-pentadiene, 4-methyl-1,3-pentadiene, 1,4-pentadiene, 2-methyl-1,4-pentadiene, 1,2-hexadiene, 1,3-hexadiene, 1,4-hexadiene, 1,5-hexadiene, 2,5-dimethyl-1,5-hexadiene, 3,3-dimethyl-1,5-hexadiene, 2-methyl-1,5-hexadiene, 3-methyl-1,5-hexadiene, 2,4-hexadiene, 2,5-dimethyl-2,4-hexadiene, 5,5-dimethyl-2,4-hexadiene, octadiene, nonadiene, 1,9-decadiene, and 1,10-undecadiene), styrene derivatives (such as styrene, o-methylstyrene, m-methylstyrene, p-methylstyrene, dimethylstyrene, trimethylstyrene, isopropylstyrene, methoxystyrene, nitrostyrene, aminostyrene, p-vinylbenzenesulfonic acid, sodium p-vinylbenzenesulfonate, potassium p-vinylbenzenesulfonate, α-methylstyrene, and α-ethylstyrene), vinyl ester derivatives (such as vinyl acetate, vinyl butyrate, vinyl pivalate, vinyl caprylate, vinyl laurate, vinyl palmitate, vinyl stearate, vinyl methacrylate, vinyl crotonate, vinyl cinnamate, vinyl benzoate, vinyl nitrobenzoate, and vinyl formate), vinyl ether derivatives (such as methyl vinyl ether, ethyl vinyl ether, n-propyl vinyl ether, isopropyl vinyl ether, n-butyl vinyl ether, isobutyl vinyl ether, tert-butyl vinyl ether, 2-ethylhexyl vinyl ether, n-octadecyl vinyl ether, divinyl ether, allyl vinyl ether, benzyl vinyl ether, phenyl vinyl ether, 2-methoxyethyl vinyl ether, and diethylene glycol divinyl ether), acrylic acid derivatives (such as acrylic acid, acrylic anhydride, acrolein, crotonic acid, isocrotonic acid, angelic acid, tiglic acid, dimethylacrylic acid, methylethylacrylic acid, α-[N-acrylo]aminoacrylic acid, α-acetoxyacrylic acid, α-trimethylsilylacrylic acid, and sodium acrylate), methacrylic acid derivatives (such as methacrylic acid, methacrylic acid anhydride, methacrolein, and sodium methacrylate), acrylic acid ester derivatives (such as methyl acrylate, ethyl acrylate, propyl acrylate, butyl acrylate, 10-undecyl acrylate, 2-methylbutyl acrylate, vinyl acrylate, 2-ethylhexyl acrylate, 2-ethoxyethyl acrylate, octadecyl acrylate, cyclohexyl acrylate, 2-hydroxyethyl acrylate, 2-hydroxypropyl acrylate, and phenyl acrylate), methacrylic acid ester derivatives (such as methyl methacrylate, ethyl methacrylate, propyl methacrylate, n-octyl methacrylate, 2-ethylhexyl methacrylate, 2-cyanoethyl methacrylate, isobutyl methacrylate, tridecyl methacrylate, and vinyl methacrylate), acrylamide derivatives (such as acrylamide, N-methylacrylamide, N-tert-butylacrylamide, and N-benzylacrylamide), methacrylamide derivatives (such as methacrylamide, N-methylmethacrylamide, N-tert-butylmethacrylamide, and N-benzylmethacrylamide), acrylonitrile derivatives (such as acrylonitrile, 2-ethylacrylonitrile, and 2-phenylacrylonitrile), methacrylonitrile derivatives, maleic acid derivatives (such as maleic anhydride, methylmaleic anhydride, dimethylmaleic anhydride, phenylmaleic anhydride, maleic acid, methylmaleic acid, dimethylmaleic acid, and phenylmaleic acid), maleic acid ester derivatives (such as monomethyl maleate, dimethyl maleate, monoethyl maleate, diethyl maleate, monobutyl maleate, and dibutyl maleate), maleamide derivatives (such as maleamic acid and maleic acid diamide), maleimide derivatives (such as maleimide, N-methylmaleimide, and N-ethylmaleimide), dicarboxylic acid derivatives (such as oxalic acid, malonic acid, succinic acid, tartaric acid, itaconic acid, acetylenedicarboxylic acid, glutaric acid, and 3-methylglutaric acid), and dicarboxylic acid ester derivatives (such as monoethyl oxalate, monophenyl oxalate, monoethyl malonate, monophenyl malonate, monoethyl succinate, monophenyl succinate, monoethyl tartarate, monoethyl itaconate, monoethyl fumarate, monoethyl acetylenemonocarboxyliate, monoethyl glutarate, diethyl oxalate, diphenyl oxalate, diethyl malonate, diphenyl malonate, diethyl succinate, diphenyl succinate, diethyl tartarate, diethyl itaconate, diethyl fumarate, diethyl acetylenedicarboxylate, and diethyl glutarate). Among them, those which are especially high in hydrophobicity are styrene derivatives (such as styrene, o-methylstyrene, m-methylstyrene, p-methylstyrene, dimethylstyrene, trimethylstyrene, isopropylstyrene, methoxystyrene, nitrostyrene, aminostyrene, α-methylstyrene, and α-ethylstyrene), vinyl ether derivatives (such as allyl vinyl ether, benzyl vinyl ether, and phenyl vinyl ether), acrylic acid ester derivatives (such as phenyl acrylate), methacrylic acid ester derivatives, and dicarboxylic acid ester derivatives (such as monophenyl oxalate, monophenyl malonate, monophenyl succinate, diphenyl oxalate, diphenyl malonate, and diphenyl succinate). These examples are only a part of those which are usable and monomers specifically mentioned in "Polymer Data Handbook, Basic Edition" (edited by Polymer Society and published from Baifukan Co. in 1986) are included. In addition, there are included hydrophilic and hydrophobic monomers mentioned in Japanese Patent Kokai Nos. Sho 54-90251, 55-108411, 56-47477, 58-189299, 59-73540, 59-89313, 59-108075, and 61-228081 and besides, ethylene oxide, propylene oxide, butylene oxide, styrene oxide, epichlorohydrin, long chain α-olefin oxides and the like. The association forming polymers used in the present invention are not limited to these examples and there may be used any of those polymers and polymer emulsions which associate with latexes, microcapsules and others in the pH range of 7–14 by interaction between the hydrophobic groups. Furthermore, these polymers can be imparted with alkali-thickening property by letting them contain as monomer units monomers used for known water-soluble viscosity increasing agents such as acrylic acid, methacrylic acid and itaconic acid. The alkali-thickening property means such behavior that Brookfield viscosity of a coating composition increases with pH changing from acidic side to alkaline side (pH=7–14).

Amount of the association forming polymers used varies depending on their bonding strength by association, but is preferably 0.1–20 parts by solid weight, especially preferably 0.1–10 parts by solid weight based on 100 parts by solid weight of the microcapsules. When the association forming polymers are used in the form of the alkali-thickening type, amount thereof is preferably 0.1–5 parts by solid weight.

Being different from the above proposals (Japanese Patent Kokai Nos. Sho 61-151271, 61-192586, 61-241185, and 61-241186), according to the present invention, the latex can be efficiently localized around the microcapsules to such extent that color formation is not hindered by using the association forming polymers. Thus, the coating composition can be coated without causing rupture of the microcapsules at coating with use of a binder in a smaller amount and as a result, a carbonless copying paper excellent in color developing performance and resistance to smudging due to color formation can be obtained. Moreover, by considerably inhibiting penetration of the latex into a support, a proper support covering effect can be obtained and raggedness on the microcapsules coated surface can be eliminated and thus beautifulness and transferability of ink can be markedly improved. For only inhibition of the penetration, this can be attained to some extent by using the above-mentioned alkali-thickening type latex, but it has been impossible to localize the latex efficiently and to such extent that color formation is not hindered. On this point, the present invention has the effect different from conventional techniques and further includes a carbonless copying paper prepared by coating a coating composition which contains virtually no particles having a size of 10 μm or greater in diameter (stilt agent or the like) as monitored by 50% volume mean value according to Coulter counter method and drying the coated layer.

It is preferred that Brookfield viscosity of the coating composition used is adjusted, for example, to 1–1000 cps in the case of solid concentration being 20% (temperature of the coating composition=20° C.). This is an example of measuring conditions and the present invention is not limited to these concentration and temperature of the coating composition. If the viscosity is less than the above range, the effect of the present invention is difficult to attain and if it is more than the range, coating rheology is inferior.

When the association forming polymer is used in the coating composition, the binders used are preferably styrene-butadiene copolymer type latex, vinyl acetate type and acrylic type latexes and alkali-thickening type latexes thereof. Mixtures of them are also preferred. As the alkali-thickening type latexes, there may be used the above-mentioned ones which are generally used. Regarding amount of the binder used, amount of not alkali-thickening type latexes is preferably 5–100 parts by solid weight and that of alkali-thickening type latexes is preferably 5–70 parts by solid weight based 100 parts by solid weight of the microcapsules.

It is also possible to use water-soluble polymers such as starch, casein, gelatin, gum arabic, polyvinyl alcohol, methyl cellulose and carboxymethyl cellulose in a suitable amount as the binder component other than the latex. Amount of these binders other than the latex is preferably 0–100 parts by solid weight, especially preferably 0–50 parts by solid weight based on 100 parts by solid weight of the microcapsules.

The microcapsules coating layer of the present invention may contain various pigment of less than 3 μm in diameter as determined by volume mean value according to Coulter counter method in such an amount not to harmfully affect smoothness of the coated surface. There are no limitations regarding selection of pigments and any kind of them, so long as they fulfill the aforesaid requirement and are of those commonly used in carbonless copying paper. Typical examples thereof are pigments made of various plastics, hollow pigments made of various plastics, calcium oxide, calcium hydroxide, calcium carbonate, calcium metasilicate, magnesium hydroxide, magnesium carbonate, magnesium oxide, aluminum hydroxide and aluminum silicate.

The coating composition in the present invention can contain substances which show defoaming action or foam-suppression action in a suitable amount. These substances are not critical as far as they are those which are used for general pressure-sensitive copying papers. Examples thereof are alcohols such as propyl alcohol, butyl alcohol, amyl alcohol, octyl alcohol, lauryl alcohol, cetyl alcohol and polyalkylene glycols; fatty acids; fatty acid esters such as sorbitan monolaurate, sorbitan trioleate, polyoxyethylene ether, isoamyl stearate, and ethylene glycol laurate; amines; amides such as stearylamide, butanedicetylamide, and distearylethylenediamine; ethers; phosphoric esters; metallic soaps such as aluminum palmitate, aluminum stearate, calcium stearate, and magnesium stearate; silicones; and mixtures thereof. These may be determined depending on use and the desired characteristics.

The color formers (electron-donating color formers) have no special limitation as far as they are those which are used for general pressure-sensitive copying papers.

Examples thereof are as follows.

(1) Triarylmethane compounds:

3,3-Bis(p-dimethylaminophenyl)-6-dimethylaminophthalide (crystal violet lactone), 3,3-bis(p-dimethylaminophenyl)phthalide, 3-(p-dimethylaminophenyl)-3-(1,2 -dimethylindol-3-yl)phthalide, 3-(p-dimethylaminophenyl)-3-(2-methylindol-3-yl)phthalide, 3-(p-dimethylaminophenyl)-3-(2-phenylindol-3-yl)phthalide, 3,3-bis(1,2-dimethylindol-3-yl)-5-dimethylaminophthalide, 3,3-bis-(1,2-dimethylindol-3-yl)-6-dimethylaminophthalide, 3,3-bis-(9-ethylcarbazol-3-yl)-5-dimethylaminophthalide, 3,3-bis(2-phenylindol-3-yl)-5-dimethylaminophthalide, and 3-p-dimethylaminophenyl-3-(1-methylpyrrol-2-yl)-6-dimethylaminophthalide.

(2) Diphenylmethane compounds:

4,4'-Bis-dimethylaminobenzhydrinebenzyl ether, N-halophenylleucoauramine, and N-2,4,5-trichlorophenylleucoauramine.

(3) Xanthene compounds:

Rhodamine B-anilinolactam, Rhodamine B-p-nitroanilinolactam, Rhodamine B-p-chloroanilinolactam, 3-diethylamino-7-dibenzylaminofluoran, 3-diethylamino-7-octylaminofluoran, 3-diethylamino-7-phenylfluoran, 3-diethylamino-7-(3,4-dichloroanilino)-fluoran, 3-diethylamino-7-(2-chloroanilino)fluoran, 3-diethylamino-6-methyl-7-xylidinofluoran, 3-diethylamino-6-methyl-7-anilinofluoran, 3-dibutylamino-6-methyl-7-anilinofluoran, 3-cyclohexylmethylamino-6-methyl-7-anilinofluoran, 3-isobutylethylamino-6-methyl-7-anilinofluoran, 3-piperidino-6-methyl-7-anilinofluoran, 3-ethyl-tolylamino-6-methyl-7-anilinofluoran, 3-ethyltolylamino-6-methyl-7-phenethylfluoran, and 3-diethylamino-7-(4-nitroanilino)fluoran.

(4) Thiazine compounds:

Benzoylleuco methylene blue and p-nitrobenzoylleuco methylene blue.

(5) Spiro compounds:

3-Methyl-spiro-dinaphthopyran, 3-ethyl-spiro-dinaphthopyran, 3,3'-dichloro-spiro-dinaphthopyran, 3-benzylspiro-dinaphthopyran, 3-methylnaphtho-(3-methoxybenzo)-spiropyran, and 3-propyl-spiro-dibenzopyran.

Furthermore, mention may be made of the electron-donating color formers described in Japanese Patent Kokai No. Sho 63-230387 and "Dyes for Pressure-Sensitive and Heat-Sensitive Recording Papers" (Shikizai, 61 [5], p. 292–302, 1988).

Besides, mixtures of the above compounds may also be used. These are determined depending on use and desired characteristics.

When the electron-donating color former is microencapsulated, normally the color former is dissolved in a hydrophobic medium and this is used as a core material. The hydrophobic medium has no limitation and any of those which are used for general pressure-sensitive copying papers may be used. Examples of the hydrophobic medium are shown below.

(a) Aromatic hydrocarbons:

Diarylethane, alkylbiphenyl, alkylterphenyl, alkylnaphthalene, triarylmethane, diphenylalkane, hydroanthracene, hydrophenanthrene, and dibenzyltoluene.

(b) Mineral oils:

Kerosine, paraffin, naphthenic oil, and chlorinated paraffin.

(c) Vegetable oils:

Cotton oil, corn oil, and coconut oil.

(d) Alcohols:

Oleyl alcohol, tridecyl alcohol, benzyl alcohol, 1-phenylethyl alcohol, and glycerine.

(e) Organic acids:

Oleic acid.

(f) Esters:

Dimethyl phthalate, diethyl phthalate, di-n-butyl phthalate, dioctyl phthalate, diethyl adipate, propyl adipate, di-n-butyl adipate, and dioctyl adipate.

(g) Organic phosphoric acid compounds:

Tricresyl phosphate, tributyl phosphite, and tributyl phosphite oxide.

(h) Ethers:

Phenyl cellosolve, benzylcarbitol, polypropylene glycol, and propyleneglycol monophenyl ether.

(i) Amides:

N,N-dimethyllauramide, N,N-dimethylstearamide, and N,N-dihexyloctylamide.

(j) Ketones.

Diisobutyl ketone and methyl hexyl ketone.

(k) Aklyl carbonates:

Ethylene carbonate and propylene carbonate.

Mixtures of the above compounds may also be used. These are determined depending on use and the desired characteristics.

Furthermore, when the electron-donating color former is microencapsulated, materials such as ultraviolet absorber and infrared absorber may also be simultaneously dissolved in the hydrophobic medium. These have no limitation and any of those which are used in general pressure-sensitive copying papers may be used.

Examples of the ultraviolet absorber are shown below.

(a) Salicyclic acids:

Phenyl salicyclate, p-tert-butylphenyl salicylate, and p-octylphenyl salicylate.

(b) Benzophenones:

2,4-Dihydroxybenzophenone, 2-hydroxy-4-methoxybenzophenone, 2-hydroxy-4-octoxybenzophenone, 2-hydroxy-4-dodecyloxybenzophenone, 2,2'-dihydroxy-4-methoxybenzophenone, 2,2'-dihydroxy-4,4'-dimethoxybenzophenone, and 2-hydroxy-4-methoxy-5-sulfobenzophenone.

(c) Benzotriazoles:

2-(2'-Hydroxy-5'-methylphenyl)benzotriazole, 2-(2'-hydroxy-5'-tert-butylphenyl)benzotriazole, 2-(2'-hydroxy-3',5'-di-tert-butylphenyl)benzotriazole, 2-(2'-hydroxy-3'-tert-butyl-5'-methylphenyl)-5-chlorobenzotriazole, 2-(2'-hydroxy-3',5'-di-tert-amylphenyl)benzotriazole, and 2-(2'-hydroxy-4'-octoxyphenyl)benzotriazole.

(d) Cyanoacrylates:

2-Ethylhexyl-2-cyano-3,3'-diphenyl acrylate and ethyl-2-cyano-3,3'-diphenyl acrylate.

Mixtures of these compounds may also be used. These are determined depending on use and the desired characteristics.

There appears to be no need to critically specify encapsulation method employed in the present invention, but since microcapsules wall prepared by coacervation method is broken sometimes when mixed with latexes, interfacial polymerization method or in-situ polymerization method is preferred. Emulsifiers used for the in-situ polymerization method are preferably polyelectrolytes. Examples thereof are aqueous solutions or mixed aqueous solutions of styrene-maleic anhydride copolymer, styrene-benzyl methacrylate-maleic anhydride copolymer, α-alkylstyrene-maleic anhydride copolymer, nuclear monoalkyl-substituted styrene-maleic anhydride copolymer, nuclear dialkyl-substituted styrene-maleic anhydride copolymer, styrene-anhydrous monoalkyl maleate copolymer, ethylene-maleic anhydride copolymer, polystyrenesulfonic acid, polyacrylic acid, and acrylic acid-acrylate ester copolymer. As emulsifiers used for encapsulation by the interfacial polymerization method, there may be used aqueous solutions or mixed aqueous solutions of polyvinyl alcohol, carboxymethyl cellulose, hydroxyethyl cellulose, and various starches such as wheat, potato and corn starches in addition to those used for the in-situ polymerization method.

Further, there may be added known substances having nonionic, cationic or amphoteric surface activity in such an amount not to hinder the encapsulation process.

The coating composition is coated by ordinary coaters and dried. Examples of the coater are air knife coater, blade coater, rod coater, bar coater, roll coater, size press coater, and curtain coater. In the present invention, contact coating method is especially effective among these various coating methods.

As supports, acidic paper or alkaline paper mainly composed of cellulosic fibers is normally used, but synthetic paper may also be suitably used. Regenerated papers made from wasted papers, other various regenerated papers and the like may also be used.

The color developers used in combination with the carbonless pressure-sensitive copying paper of the present invention include, for example, phenolic resin compounds, salicylic acid-based metallic salt compounds and other various inorganic and organic solid acid compounds. These may be used singly or in combination.

The following examples and comparative examples will explain the nature of the present invention in detail, but are not intended to be limiting in any way and therefore, materials and production conditions should also be not limited to those which were employed therein. The "part" referred to herebelow is by dry solid weight unless otherwise notified.

EXAMPLE 1

[Microencapsulation]

A solution was prepared by dissolving 4 parts of crystal violet lactone (CVL) in 96 parts of a diarylethane solvent (HISOL SAS N-296 of Japan Petrochemical Co.).

220 parts of the above hydrophobic solution was gradually added under vigorous stirring to 180 parts of a 5% aqueous solution of styrene-maleic acid copolymer (Arakawa Chemical Co.) and stirring was continued until particle size reached 5 microns in volume mean diameter to obtain an emulsion.

Separately, an aqueous solution of melamineformaldehyde precondensate was prepared by dissolving with heating 11 parts of melamine, 21.2 parts of 37% aqueous formaldehyde solution and 28.2 parts of water. This aqueous solution was added to the emulsion obtained above, followed by stirring at 70° C. for 2 hours to obtain a microcapsule liquor.

[Preparation of an upper sheet (CB) for carbonless pressure-sensitive copying paper]

To 100 parts of the above microcapsules were added 35 parts of wheat starch and 20 parts of an amphoteric latex of a styrene-butadiene copolymer having a quanternary alkylamine group on the surface (ACORSTAR C122 of Mitsui Cyanamide Co.). At the time of the addition, pH of the latex and the other materials was adjusted so that the latex properly aggregated around the anionic microcapsules to finally obtain a coating composition of pH=9.0 for carbonless copying paper.

The coating composition was coated on a woodfree paper of 40 g/m$^2$ by air knife coating method at a dry capsule coating amount of 2.5 g/m$^2$ to obtain an upper sheet (CB) for carbonless copying paper.

[Measurement of color density and smudge due to color formation under static pressure]

The resulting CB and a commercially available lower sheet for carbonless copying paper (N-40 of lower sheet of Mitsubishi NCR having a basis weight of 40 g/m$^2$) were superimposed and color density and smudge due to color formation under static pressure thereof were measured in the following manner.

Color density:

A pressure of 400 kg/cm$^2$ was applied to the superimpossed upper sheet and lower sheet to form a color. Reflectance of the CF sheet was measured by a color difference meter ND101DP of Nihon Denshoku Kogyo Co. The color density was expressed by reflectance of colored portion/reflectance of not colored portion (background)×100 (%).

The smaller the value, the higher color density.

Smudge due to color formation under static pressure:

The superimposed upper sheet and lower sheet were kept under a pressure of 20 kg/cm$^2$ for 60 seconds and smudge formed on the lower sheet was evaluated by the same method as in measurement of the color density mentioned above.

The greater the value, the less smudge due to color formation.

EXAMPLE 2

Example 1 was repeated except that 10 parts of an alkaline viscosity unincreasing type styrene-butadiene copolymer latex (#0853 of Japan Synthetic Rubber Co., Ltd.) and 10 parts of ACORSTAR C122 were used in place of 20 parts of ACORSTAR C122.

EXAMPLE 3

Example 1 was repeated except that 5 parts of #0853, 10 parts of ACORSTAR C122 and 5 parts of an alkaline viscosity unincreasing type styrene-butadiene copolymer latex (#0628 of Japan Synthetic Rubber Co., Ltd.) were used in place of 20 parts of ACORSTAR C122.

EXAMPLE 4

Example 1 was repeated except that 10 parts of #0628 and 10 parts of ACORSTAR C122 were used in place of 20 parts of ACORSTAR C122.

EXAMPLE 5

Example 1 was repeated except that 20 parts of styrene-butadiene copolymer ampholytic latex (#0861 of Japan Synthetic Rubber Co., Ltd.) was used in place of 20 parts of ACORSTAR C122.

COMPARATIVE EXAMPLE 1

Example 1 was repeated except that 20 parts of #0853 was used in place of 20 parts of ACORSTAR C122.

COMPARATIVE EXAMPLE 2

Example 1 was repeated except that 20 parts of #0628 was used in place of 20 parts of ACORSTAR C122.

COMPARATIVE EXAMPLE 3

After completion of microencapsulation in Example 1, temperature of the microcapsule liquid was kept at 60° C. and thereto was added a 10 wt % aqueous gelatin solution corresponding to 1 part by solid weight based on 100 parts by solid weight of the microcapsules. After sufficient stirring and mixing, 2 wt % hydrochloric acid was gradually added to adjust pH to 3. Then, 37 wt % formalin corresponding to 0.8 part by solid weight was added, followed by stirring for about 12 hours.

Then, Example 1 was repeated except that 19 parts of #0853 was used in place of 20 parts of ACORSTAR C122 for 101.8 parts of the above association product of microcapsules and gelatin.

Results of Examples 1–5 and Comparative Examples 1–3 are shown in Table 1.

TABLE 1

| | Blending ratio | | | | Color density | Smudge under static pressure |
|---|---|---|---|---|---|---|
| | A Part | B Part | C Part | D Part | % | % |
| Example 1 | | | 20.0 | | 35.9 | 94.8 |
| Example 2 | 10.0 | | 10.0 | | 36.1 | 94.7 |
| Example 3 | 5.0 | 5.0 | 10.0 | | 36.0 | 95.1 |
| Example 4 | | 10.0 | 10.0 | | 35.8 | 95.3 |
| Example 5 | | | 20.0 | | 35.8 | 94.6 |
| Comparative Example 1 | 20.0 | | | | 35.8 | 91.4 |
| Comparative Example 2 | | 20.0 | | | 36.1 | 92.3 |
| Comparative Example 3 | 19.0 | | | 1.0 | 37.4 | 92.1 |

A: Alkaline viscosity unincreasing type latex.
B: Alkaline viscosity increasing type latex.
C: Ampholytic latex.
D: Ampholytic polymer (gelatin).

EXAMPLE 6

[Microencapsulation]

Microencapsulation was carried out in the same manner as in Example 1.

[Preparation of an upper sheet (CB) for carbonless pressure-sensitive copying paper]

To 100 parts of the microcapsules obtained above were added 35 parts of wheat starch and 19 parts of a styrene-butadiene copolymer latex (#0853 of Japan Synthetic Rubber Co., Ltd.), which is not of alkali-thickening type, and 1 part of an alkali-thickening type association forming polymer emulsion of acrylic acid-acrylate ester copolymer (TT-615 of Rohm & Haas Co.). The mixture was adjusted to pH 9.0 to obtain a coating composition for carbonless pressure-sensitive copying paper.

The coating composition was coated on a woodfree paper of 40 g/m$^2$ by air knife coating method at a dry capsule coating amount of 2.5 g/m$^2$ to obtain an upper sheet (CB) for carbonless pressure-sensitive copying paper.

The thus obtained upper sheet was evaluated in the same manner as in Example 1.

EXAMPLE 7

Example 6 was repeated except that 9.5 parts of #0853 and 9.5 parts of an alkali-thickening type styrene-butadiene copolymer latex (#0628 of Japan Synthetic Rubber Co., Ltd.) were used in place of 19 parts of #0853.

EXAMPLE 8

Example 6 was repeated except that 19 parts of #0628 was used in place of 19 parts of #0853.

EXAMPLE 9

Example 6 was repeated except that #0853 was used in an amount in the range of 5–55 parts was used in place of 19 parts of #0853.

COMPARATIVE EXAMPLE 4

Example 6 was repeated except that 20 parts of #0853 was used in place of 19 parts of #0853 and 1 part of TT-615.

COMPARATIVE EXAMPLE 5

Example 6 was repeated except that 19 parts of #0853 and 1 part of alkali-thickening type polymer emulsion (ASE-75 of Rohm & Haas Co.) were used in place of parts of #0853 and 1 part of TT-615.

COMPARATIVE EXAMPLE 6

Example 6 was repeated except that 19 parts of #0628 and 1 part of ASE-75 were used in place of 19 parts of #0853 and 1 part of TT-615.

COMPARATIVE EXAMPLE 7

Example 6 was repeated except that 20 parts of #0628 was used in place of 19 parts of #0853 and 1 part of TT-615.

COMPARATIVE EXAMPLE 8

Example 6 was repeated except that ASE-75 was not used or used in a fixed amount of 1 part and #0853 was used in an amount in the range of 5–60 parts in place of 19 parts of #0853 and 1 part of TT-615.

Results of Examples 6–8 and Comparative Examples 4–7 are shown in Table 2 and results of Example 9 and Comparative Example 8 are shown in Table 3.

TABLE 2

| | Blending ratio | | | | Color density | Smudge under static pressure |
|---|---|---|---|---|---|---|
| | A Part | B Part | C Part | D Part | % | % |
| Example 6 | 19.0 | | | 1.0 | 35.8 | 96.2 |
| Example 7 | 9.5 | 9.5 | | 1.0 | 36.0 | 97.1 |
| Example 8 | | 19.0 | | 1.0 | 36.4 | 97.3 |
| Comparative Example 4 | 20.0 | | | | 35.9 | 91.6 |
| Comparative Example 5 | 19.0 | | 1.0 | | 36.0 | 92.5 |
| Comparative Example 6 | | 19.0 | 1.0 | | 35.8 | 93.1 |
| Comparative Example 7 | | 20.0 | | | 36.1 | 92.6 |

A: Not alkali-thickening type latex.
B: Alkali-thickening type latex.
C: Alkali-thickening type polymer emulsion.
D: Alkali-thickening type association forming polymer emulsion.

TABLE 3

| | Comparative Example 8 | | | | Example 9 | |
|---|---|---|---|---|---|---|
| | Not used | | C 1 part | | D 1 part | |
| A Amount Part | Color density % | Stain under static pressure % | Color density % | Stain under static pressure % | Color density % | Stain under static pressure % |
| 5 | 34.5 | 91.0 | 35.0 | 91.8 | 35.6 | 95.1 |

TABLE 3-continued

| | Comparative Example 8 | | | | Example 9 | |
|---|---|---|---|---|---|---|
| | Not used | | C 1 part | | D 1 part | |
| A Amount Part | Color density % | Stain under static pressure % | Color density % | Stain under static pressure % | Color density % | Stain under static pressure % |
| 10 | 34.8 | 91.5 | 34.6 | 92.2 | 35.5 | 95.5 |
| 15 | 35.0 | 91.8 | 35.5 | 92.6 | 36.0 | 96.3 |
| 20 | 35.8 | 92.0 | 35.8 | 92.5 | 35.8 | 96.4 |
| 40 | 35.9 | 93.9 | 36.4 | 94.5 | 36.5 | 97.7 |
| 55 | | | | | 36.7 | 97.9 |
| 60 | 40.6 | 95.0 | 40.4 | 95.5 | | |

A: Not alkali-thickening type latex.
C: Alkali-thickening type polymer emulsion.
D: Alkali-thickening type association forming polymer emulsion.

EXAMPLE 10

[Microencapsulation]

Microencapsulation was carried out in the same manner as in Example 1 except that the emulsion was prepared by continuing the stirring until diameter monitored by 50% volume mean value according to Coulter counter method reached 3 μm.

[Preparation of an upper sheet (CB) for carbonless pressure-sensitive copying paper]

To 100 parts of the microcapsules obtained above were added 19 parts of a styrene-butadiene copolymer latex (#0853 of Japan Synthetic Rubber Co., Ltd.), which is not of alkali-thickening type, and 1 part of an alkali-thickening type association forming polymer emulsion of acrylic acid-acrylate ester copolymer (TT-615 of Rohm & Haas Co.). The mixture was adjusted to pH 9.0 to obtain a coating composition for carbonless copying paper.

The coating composition was coated on a woodfree paper of 40 g/m$^2$ by fountain blade coater at a dry capsule coating amount of 2.5 g/m$^2$ to obtain an upper sheet (CB) for carbonless pressure-sensitive copying paper.

The thus obtained upper sheet was evaluated on color density and smudge due to color formation under static pressure in the same manner as in Example 1. The sheet was further evaluated on smudge due to color formation by dynamic friction, ink transferability and feel in the following manner.

Smudge due to color formation caused by a dynamic friction:

The superimposed upper sheet and lower sheet were subjected to reciprocating frictions of five times under a load of 200 g by a Gakushin type dye fastness tester in accordance with JIS-L-1048. Smudge of the lower sheet was measured in the same manner as in measurement of the color density mentioned above.

The larger the value, the less smudge due to color formation by a dynamic friction.

Rupture of microcapsules at the time of coating and scraping off of stilt agent were evaluated by scanning electron microscope.

Ink transferability:

The surface of microcapsule coat (CB layer) was printed with a red ink by RI printing machine. Reflectance of the CB sheet was measured by a color difference meter ND101DP of Nihon Denshoku Kogyo Co. The result was expressed by reflectance of printed portion/reflectance of unprinted portion (background of CB)×100(%). The smaller the value, the better ink transferability.

Feel:

Comparison was made by hand feeling.

EXAMPLE 11

Example 10 was repeated except that 9.5 parts of #0853 and 9.5 parts of an alkaline viscosity increasing type styrene-butadiene copolymer latex (#0628 of Japan Synthetic Rubber Co., Ltd.) were used in place of 19 parts of #0853.

EXAMPLE 12

Example 10 was repeated except that 19 parts of #0628 was used in place of 19 parts of #0853.

EXAMPLE 13

Example 12 was repeated except that amount of TT-615 was changed from 1 part to 0.1 part.

EXAMPLE 14

Example 12 was repeated except that amount of TT-615 was changed from 1 part to 2 parts.

EXAMPLE 15

Example 12 was repeated except that amount of TT-615 was changed from 1 part to 3 parts.

EXAMPLE 16

Example 12 was repeated except that amount of TT-615 was changed from 1 part to 5 parts.

EXAMPLE 17

Example 12 was repeated except that an air knife coater was employed in place of the fountain blade coater.

EXAMPLE 18

Example 12 was repeated except that a curtain coater was employed in place of the fountain blade coater.

EXAMPLE 19

Example 10 was repeated except that #0853 was used in an amount in the range of 5–60 parts in place of 19 parts of #0853.

COMPARATIVE EXAMPLE 9

Example 10 was repeated except that 20 parts of #0853 was used in place of 19 parts of #0853 and 1 part of TT-615.

COMPARATIVE EXAMPLE 10

Example 10 was repeated except that 1 part of alkaline viscosity increasing type polymer emulsion (ASE-75 of Rohm & Haas Co.) were used in place of 1 part of TT-615.

COMPARATIVE EXAMPLE 11

Example 10 was repeated except that 19 parts of #0628 and 1 part of ASE-75 were used in place of 19 parts of #0853 and 1 part of TT-615.

COMPARATIVE EXAMPLE 12

Example 10 was repeated except that 20 parts of #0628 was used in place of 19 parts of #0853 and 1 part of TT-615.

COMPARATIVE EXAMPLE 13

Comparative Example 12 was repeated except that 35 parts of wheat starch (50% value of volume average diameter by Colter Counter method=15 μm) was added as a buffer to the coating composition for upper sheet.

COMPARATIVE EXAMPLE 14

Comparative Example 13 was repeated except that an air knife coated was used in place of the fountain blade coater.

COMPARATIVE EXAMPLE 15

Comparative Example 14 was repeated except that 20 parts of #0853 was used in pace of 20 parts of #0628.

COMPARATIVE EXAMPLE 16

Example 13 was repeated except that a curtain coater was used in place of the fountain blade coater.

COMPARATIVE EXAMPLE 17

Comparative Example 12 was repeated except that 35 parts of wheat starch (50% value of volume average diameter by Colter Counter method=15 μm) was added as a buffer to the coating composition for upper sheet and besides an air knife coater was employed in place of the fountain blade coater.

COMPARATIVE EXAMPLE 18

Comparative Example 17 was repeated except that a curtain coater was employed in place of the fountain blade coater.

COMPARATIVE EXAMPLE 19

Example 10 was repeated except that ASE-75 was not used or used in a fixed amount of 1 part and #0853 was used in an amount of the range of 5–60 parts in place of 19 parts of #0853 and 1 part of TT-615.

Results of Examples 10–18 and Comparative Examples 9–18 are shown in Table 4.

Results of Example 19 and Comparative Example 19 are shown in Table 5.

In Tables 4 and 5, evaluation of feel and overall evaluation were conducted according to the following criteria.

Feel:

Very good: Hand feeling is very good.
Good: Hand feeling is good.
Bad: Hand feeling is bad.

Overall evaluation:

⊙: The object of the present invention is sufficiently attained.
○: The object of the present invention is attained.
Δ: The object of the present invention is not attained.
x: The object of the present invention is not attained at all.

TABLE 4

| | Components of coating composition | | | | | | | Smudge due to color function | | | | | |
|---|---|---|---|---|---|---|---|---|---|---|---|---|---|
| | A Part | B Part | C Part | D Part | Wheat starch | Coating method | Color density % | Under static function % | Friction % | Rupture of micro-capsules | Ink transfer-ability % | Touch | Overall evaluation |
| Example | | | | | | | | | | | | | |
| 10 | 19.0 | | | 1.0 | No | Blade | 37.9 | 97.5 | 90.7 | No | 41.5 | Very good | ⊙ |
| 11 | 9.5 | 9.5 | | 1.0 | " | " | 38.1 | 97.2 | 91.5 | " | 42.1 | " | " |
| 12 | | 19.0 | | 1.0 | " | " | 38.4 | 98.1 | 92.9 | " | 41.9 | " | " |
| 13 | | 19.0 | | 0.1 | " | " | 37.8 | 97.2 | 90.3 | " | 42.5 | " | " |
| 14 | | 19.0 | | 2.0 | " | " | 38.5 | 98.3 | 93.1 | " | 40.7 | " | " |
| 15 | | 19.0 | | 3.0 | " | " | 38.6 | 98.5 | 94.8 | " | 40.1 | " | " |
| 16 | | 19.0 | | 5.0 | " | " | 38.4 | 98.7 | 96.7 | " | 39.7 | " | " |
| 17 | | 19.0 | | 1.0 | " | Air | 38.1 | 98.3 | 94.0 | " | 40.8 | " | " |
| 18 | | 19.0 | | 1.0 | " | Curtain | 38.3 | 98.3 | 92.5 | " | 39.9 | " | " |
| Comparative Example | | | | | | | | | | | | | |
| 9 | 20.0 | | | | No | Blade | 37.7 | 92.3 | 79.5 | Occurred | 49.1 | Bad | x |
| 10 | 19.0 | | 1.0 | | " | " | 38.1 | 92.8 | 80.4 | " | 47.2 | " | " |
| 11 | | 19.0 | 1.0 | | " | " | 37.9 | 93.9 | 81.7 | " | 46.7 | Good | Δ |
| 12 | | 20.0 | | | " | " | 38.1 | 93.5 | 81.1 | " | 46.5 | " | " |
| 13 | | 20.0 | | | Present | " | 38.8 | 90.4 | 75.8 | " | 59.3 | Bad | x |
| 14 | | 20.0 | | | " | Air | 38.9 | 95.6 | 85.6 | No | 57.4 | " | " |
| 15 | 20.0 | | | | " | " | 39.2 | 94.3 | 81.2 | " | 56.2 | " | " |
| 16 | | 20.0 | | | " | Curtain | 40.1 | 95.4 | 85.3 | " | 56.9 | " | " |
| 17 | | 19.0 | | 1.0 | " | Air | 39.9 | 99.7 | 96.5 | " | 56.1 | " | Δ |

TABLE 4-continued

| | Components of coating composition | | | | | | | Smudge due to color function | | | | | |
|---|---|---|---|---|---|---|---|---|---|---|---|---|---|
| | A Part | B Part | C Part | D Part | Wheat starch | Coating method | Color density % | Under static function % | Friction % | Rupture of micro-capsules | Ink transfer-ability % | Touch | Overall evaluation |
| 18 | | 19.0 | | 1.0 | " | Curtain | 39.8 | 99.5 | 96.1 | " | 55.7 | " | " |

A: Not alkali-thickening type latex.
B: Alkali-thickening type latex.
C: Alkali-thickening type polymer emulsion.
D: Alkali-thickening type association forming polymer emulsion.
(In Comparative Example 5, "scraping phenomenon" which means insufficient coating of wheat starch occurred.)

TABLE 5

| | Components of coating composition | | | | | | Smudge due to color function | | | | | |
|---|---|---|---|---|---|---|---|---|---|---|---|---|
| | A Part | C Part | D Part | Wheat starch | Coating method | Color density % | Under static pressure % | Friction % | Rupture of micro-capsules | Ink transfer-ability % | Touch | Overall evaluation |
| Example 19 | 5.0 | | 1.0 | No | Blade | 37.6 | 98.1 | 90.4 | No | 42.7 | Very good | ◎ |
| | 10.0 | | 1.0 | " | " | 37.5 | 98.5 | 90.5 | " | 41.1 | " | " |
| | 15.0 | | 1.0 | " | " | 37.9 | 98.3 | 91.0 | " | 41.8 | " | " |
| | 20.0 | | 1.0 | " | " | 37.8 | 98.4 | 91.3 | " | 41.5 | " | " |
| | 40.0 | | 1.0 | " | " | 38.3 | 98.7 | 93.1 | " | 40.0 | " | " |
| | 55.0 | | 1.0 | " | " | 38.7 | 98.9 | 94.6 | " | 39.4 | " | " |
| | 60.0 | | 1.0 | " | " | 38.5 | 99.0 | 96.0 | " | 39.0 | " | " |
| Comparative Example 19 | 5.0 | | | " | " | 37.2 | 91.0 | 69.5 | Occurred | 56.7 | Bad | x |
| | 10.0 | | | " | " | 37.6 | 91.4 | 72.3 | " | 53.4 | " | " |
| | 15.0 | | | " | " | 38.3 | 92.4 | 78.9 | " | 49.9 | " | " |
| | 20.0 | | | " | " | 38.1 | 92.4 | 80.2 | " | 49.5 | " | " |
| | 40.0 | | | No | Blade | 38.7 | 93.1 | 81.5 | " | 49.1 | " | " |
| | 60.0 | | | " | " | 43.8 | 94.2 | 82.5 | " | 48.2 | Good | " |
| | 5.0 | 1.0 | | " | " | 37.5 | 92.2 | 70.4 | " | 55.1 | Bad | " |
| | 10.0 | 1.0 | | " | " | 37.9 | 92.2 | 76.1 | " | 52.5 | " | " |
| | 15.0 | 1.0 | | " | " | 38.0 | 92.6 | 80.6 | " | 49.1 | " | " |
| | 20.0 | 1.0 | | " | " | 38.0 | 92.8 | 81.3 | " | 47.0 | " | " |
| | 40.0 | 1.0 | | " | " | 39.1 | 94.5 | 83.3 | " | 47.2 | " | " |
| | 55.0 | 1.0 | | " | " | 43.3 | 94.1 | 83.7 | " | 47.4 | Good | " |
| | 60.0 | 1.0 | | " | " | 44.1 | 94.9 | 84.4 | " | 46.3 | " | " |

A: Not alkali-thickening type latex.
B: Alkali-thickening type polymer emulsion.
C: Alkali-thickening type association forming polymer emulsion.

As is clear from the above explanation, according to the present invention, a carbonless copying paper which sufficiently balances in color density and smudge due to color formation (color formation under static pressure and by dynamic friction) and is superior in printability and feel is obtained.

Microcapsules coating composition according to the present invention shows superior coating rheology characteristics.

Moreover, necessary amount of binder can be reduced. This is an advantageous effect outside the object.

What is claimed is:

1. A carbonless pressure-sensitive copying paper which comprises:

a paper; and a coated layer thereon formed by coating a coating composition comprising a stilt agent, a binder, microcapsules containing a color former therein, and an association forming polymer, and drying the coating composition, wherein the binder is mainly composed of a latex and the association forming polymer comprises a water-soluble polymer or polymer emulsion in which hydrophobic groups are localized at two or more positions in the polymer.

2. A carbonless pressure-sensitive copying paper according to claim 1, wherein said paper is an acidic paper or alkaline paper comprising cellulosic fibers.

3. A carbonless pressure-sensitive copying paper according to claim 1, wherein said paper comprises a synthetic paper.

4. A carbonless pressure-sensitive copying paper according to claim 1, wherein said paper comprises a regenerated paper.

5. A carbonless pressure-sensitive copying paper according to claim 1, wherein said microcapsules are anionic and said anionic microcapsules are aggregated or agglomerated by said latex which ionically associates with said anionic microcapsules at a pH within the range of 7 to 14 upon being mixed with said anionic microcapsules.

6. A carbonless pressure-sensitive copying paper according to claim 1, wherein said latex is an ampholytic latex which adheres to the surface of said microcapsules to thereby protect them.

7. A carbonless pressure-sensitive copying paper which comprises:

a paper; and a coated layer thereon formed by coating a coating composition comprising a latex, microcapsules containing a color former therein, and an association forming polymer, and drying the coating composition.

8. A carbonless copying paper according to claim 7, wherein the association forming polymer is a water-soluble polymer or polymer emulsion in which hydrophobic groups are localized at two or more positions in the polymer.

9. A carbonless copying paper according to claim 4 or 7, wherein the association forming polymer is a water-soluble polymer polymer emulsion in which hydrophobic groups are localized at at least both ends of the polymer.

10. A carbonless pressure-sensitive copying paper according to claim 1 or 7, wherein the association forming polymer is an alkali-thickening polymer.

11. A carbonless copying paper according to claim 4 or 7, wherein amount of the association forming polymer is 0.1–20 parts by solid weight based on 100 parts by solid weight of the microcapsules.

12. A carbonless pressure-sensitive copying paper according to claim 7, wherein said paper is an acidic paper or alkaline paper comprising cellulosic fibers.

13. A carbonless pressure-sensitive copying paper according to claim 7, wherein said paper comprises a synthetic paper.

14. A carbonless pressure-sensitive copying paper according to claim 7, wherein said paper comprises a regenerated paper.

15. A carbonless pressure-sensitive copying paper according to claim 7, wherein said microcapsules are anionic and said anionic microcapsules are aggregated or agglomerated by said latex which ionically associates with said anionic microcapsules at a pH within the range of 7 to 14 upon being mixed with said anionic microcapsules.

16. A carbonless pressure-sensitive copying paper according to claim 7, wherein said latex is an ampholytic latex which adheres to the surface of said microcapsules to thereby protect them.

* * * * *